United States Patent [19]

Chun

[11] 4,253,288

[45] Mar. 3, 1981

[54] PREFABRICATED WALL PANEL

[76] Inventor: Joo H. Chun, 845 S. Grand View St., Los Angeles, Calif. 90057

[21] Appl. No.: 57,385

[22] Filed: Jul. 13, 1979

[51] Int. Cl.[3] ..... E04F 13/04; E04G 21/12; E04G 21/00

[52] U.S. Cl. ..... 52/454; 52/309.11; 52/309.12; 52/741; 52/743; 264/34; 264/46.6; 264/46.7

[58] Field of Search ..... 52/741, 743, 650, 309.7, 52/309.11, 309.12, 383, 454; 156/291; 264/34, 46.6, 46.7

[56] References Cited

U.S. PATENT DOCUMENTS

| | | | |
|---|---|---|---|
| 3,305,991 | 2/1967 | Weismann | 52/309.7 X |
| 3,308,591 | 3/1967 | Goldsworthy | 52/454 |
| 3,744,194 | 7/1973 | Ramberg | 52/741 X |
| 3,879,908 | 4/1975 | Weismann | 52/309.5 |
| 4,104,842 | 8/1978 | Rockstead et al. | 52/309.12 |
| 4,107,372 | 8/1978 | Clausen et al. | 156/291 X |
| 4,125,981 | 11/1978 | MacLeod et al. | 52/741 X |

FOREIGN PATENT DOCUMENTS

| | | | |
|---|---|---|---|
| 816766 | 7/1959 | United Kingdom | 52/454 |
| 933652 | 8/1963 | United Kingdom | 52/454 |

*Primary Examiner*—Alfred C. Perham
*Attorney, Agent, or Firm*—William C. Conkle

[57] ABSTRACT

A structural and insulating panel for fabricating walls of buildings. A series of panels are interconnected into a wall at the job site and are thereafter filled with insulation by spraying liquid insulating material onto the panel-formed walls. The panels include meshes forming lateral surfaces, zig-zag wires joining the meshes together and webs and backings acting to contain the flow of liquid insulation as it is sprayed onto the walls. Conventional wall covering materials are applied over the hardened insulation, the lattice members acting as a lath. The processes of fabricating the panel and forming a wall with such panels are described.

7 Claims, 10 Drawing Figures

PREFABRICATED WALL PANEL

BACKGROUND OF THE INVENTION

This invention relates generally to modular panels used in the construction of buildings and other static structures and more specifically to insulating panels over which plaster or other surfacing materials may be applied.

Modular building panels incorporating an insulating medium are known in the art and have been described for example in U.S. Pat. Nos. 3,305,991 and 3,879,908, both to Weismann. U.S. Pat. No. 3,305,991 discloses a method of fabricating a lightweight modular structural panel by assembling elongated rods to form a rectangular lattice, placing the lattice in a tank where an amount of liquid foamed plastic insulation is introduced which is sufficient to cover the desired portion of the lattice. The plastic insulation hardens to form a unitary block which encloses and is held in place by portions of the rods of the lattice.

For many applications, the forming of the insulating block in a tank or vat is time-consuming and inconvenient. Moreover, tank molding eliminates the possibility of incorporating inside the skin of the block any item or structure which cannot be placed within the molding vat. Hence, there has existed a need for a modular building panel which can be completed in situ without the necessity of tank molding. Such a panel would, ideally, permit the blowing of liquid insulating material into a prepositioned structure. The panel should also include inexpensive and easily formed means for retaining the liquid as it is blown into the panels. Finally, the panel should have means for holding in place plaster or other wall covering that may be applied over the sides of the hardened insulation. The present invention fills these described needs.

SUMMARY OF THE INVENTION

The present invention provides an apparatus and method for making insulating modular building panels in situ by spraying liquid insulating material into a lattice structure having an impervious fabric surface to contain the liquid material and elongated rod members to hold the insulation in place when it hardens. The fabric is disposed parallel to but apart from a major lateral surface of the lattice and is retained in position by webbed materials attached to the structure of the lattice.

The lattice is comprised of a plurality of upper and lower longitudinal members and upper and lower transverse members which both form upper and lower meshes respectively, that define two major lateral surfaces. A plurality of longitudinally running zig-zag wires run between the upper and lower meshes joining them together.

A web composed of strips running laterally under the zig-zag wires and connecting to the wires holds an impervious backing in place parallel to and about ⅜ inch inside the upper major lateral surface.

The panels, which measure generally four feet by eight feet, are connected to each other along their longest edges by laborers at the job site to form a wall. The panel's upper surface, or side to which the paper is closest, is placed facing the inside of the wall. Liquid insulation, preferably polyurethane, is sprayed into the panel from the outside of the panel. Foaming agents cause the liquid insulation to begin foaming after it leaves the sprayer. The sprayed insulation strikes the backing where it foams, and hardens into an insulating mass. The hardened mass is held in position by the zig-zag wires.

Insulation is applied in layers, preferably one inch thick until the desired thickness is achieved. After the insulation hardens, it can be covered with wall coverings. Plaster is applied to the inside of the panel, the upper mesh acting as a lath. Stucco or other weatherproof coverings are applied to the outside of the panel, the lower mesh acting as a lath.

The invention permits walls to be constructed which do not require studs or other framework. The panels themselves, and their connections with adjacent panels, provide a substantial portion of the strength of the wall and the continuous layer of insulation and the wall coverings provide the rest of the strength. The continuous or unicellular character of the insulating material greatly improves the quality of the insulation since there are no gaps between the insulation in adjacent panels communicating outside air. The continuous mass of insulation also makes the insulation watertight thereby preventing leaks. Walls built from panels of the invention can be built quickly and cheaply at the job site without elaborate molding tanks. Furthermore, piping and electric wiring can be placed within the wall by locating inside the panel before the insulation is sprayed into the panel.

Other aspects and advantages of the invention will become apparent from the following more detailed description, taken in conjunction with the accompanying drawings.

DETAILED DESCRIPTION

Figure 1:
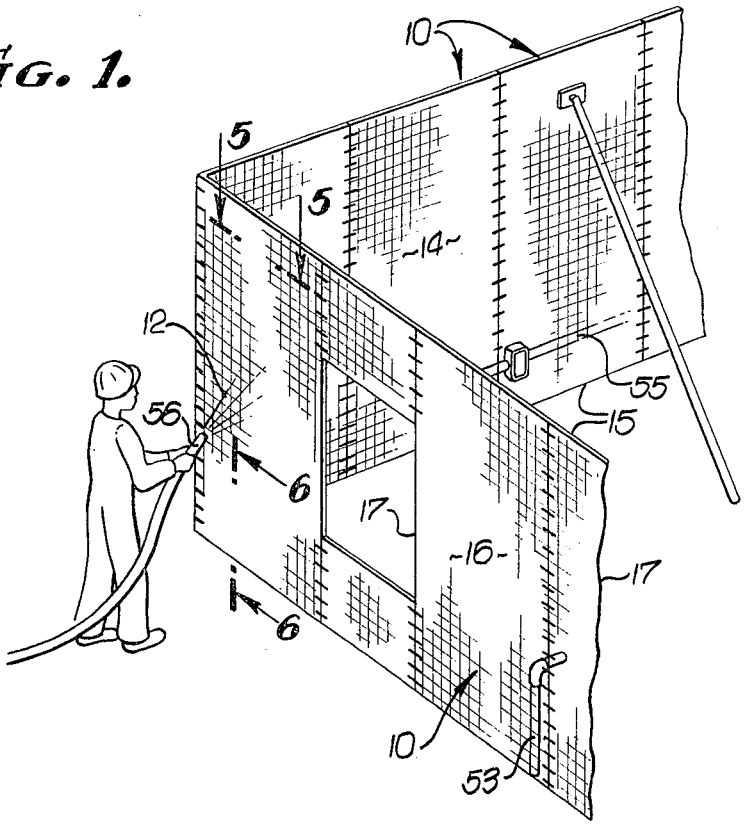
FIG. 1 is a partial view of a corner of a building showing a plurality of panels assembled in a wall and a workman applying insulation to the outside of the wall.

As shown in the drawings for purposes of illustration, the present invention resides in a modular panel 10 which when used in the construction of a building, forms a building wall that provides both an insulating medium and a suitable structure to support plaster and stucco wall surfacing materials. Modular panels 10 of the type shown in FIG. 1, permit the builder of a residential or commercial structure to form walls without using studs or other structure by connecting together a series of panels 10 to form the desired wall. An insulating mass 11 within the panel provides the insulating quality of the panel and the surface over with plaster and stucco can be applied.

Figure 2:
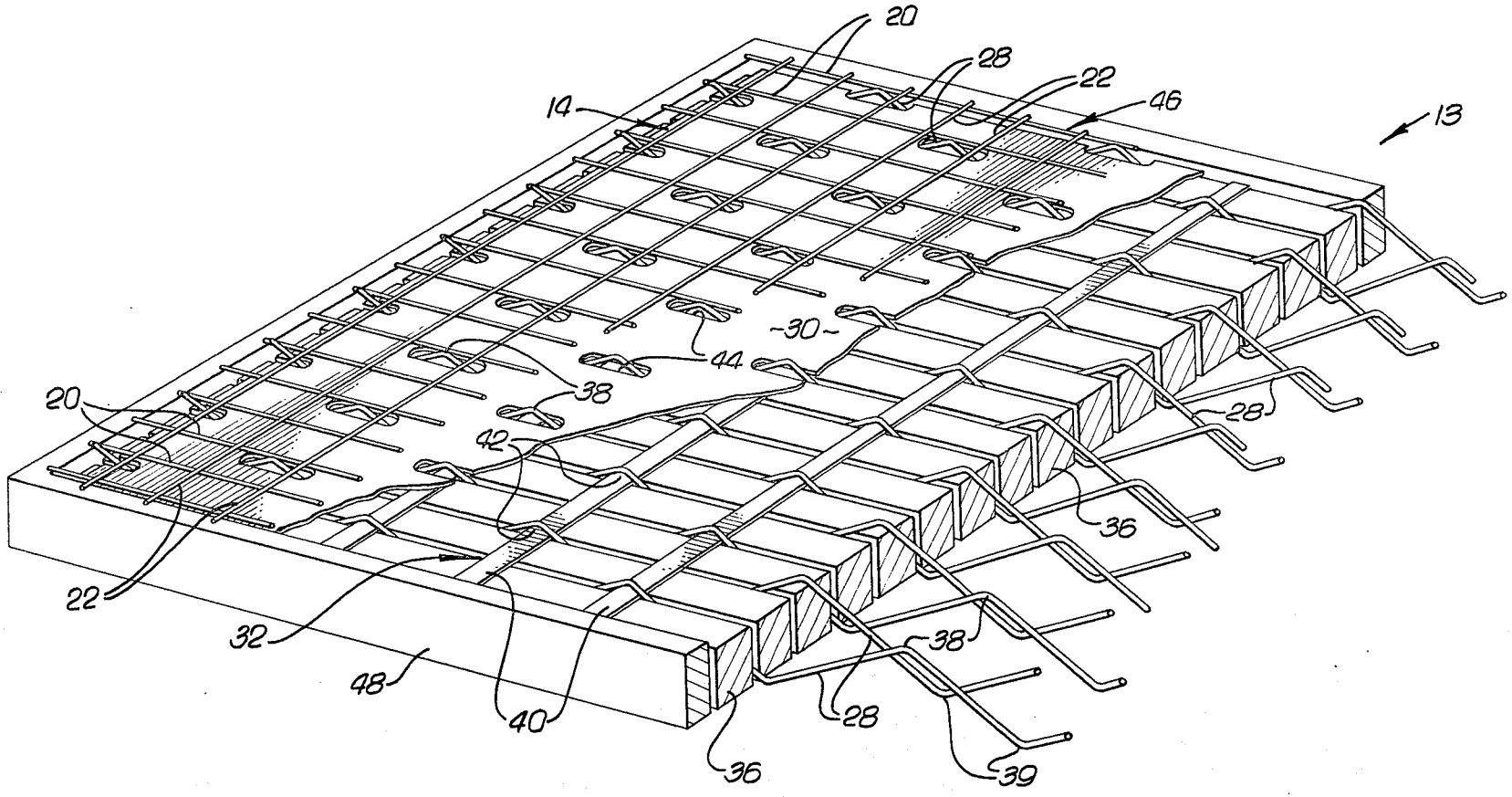
FIG. 2 is a breakway view of the panel showing a plurality of zig-zag wires, a plurality of strips, a backing, a mesh, a plurality of longitudinal forms, and an outside support holding the panel in place.
Figure 5:
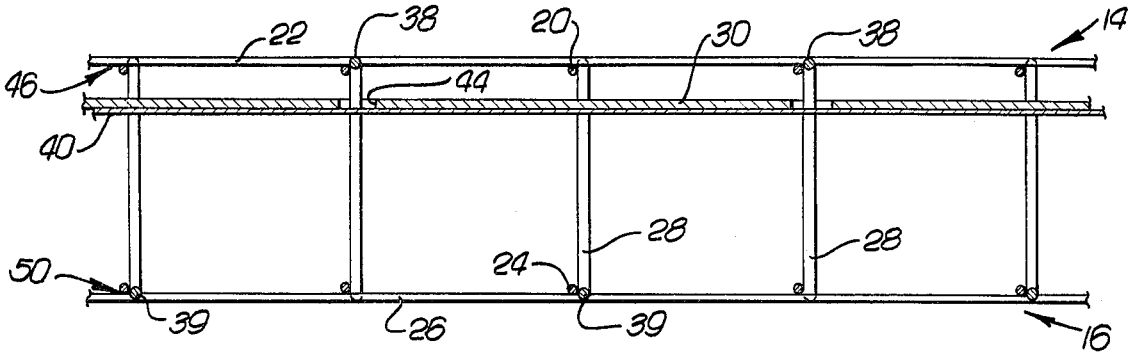
FIG. 5 is a partial horizontal section taken along line 5—5 in FIG. 1 and showing the mesh, the backing, the strips and the wires.
Figure 6:
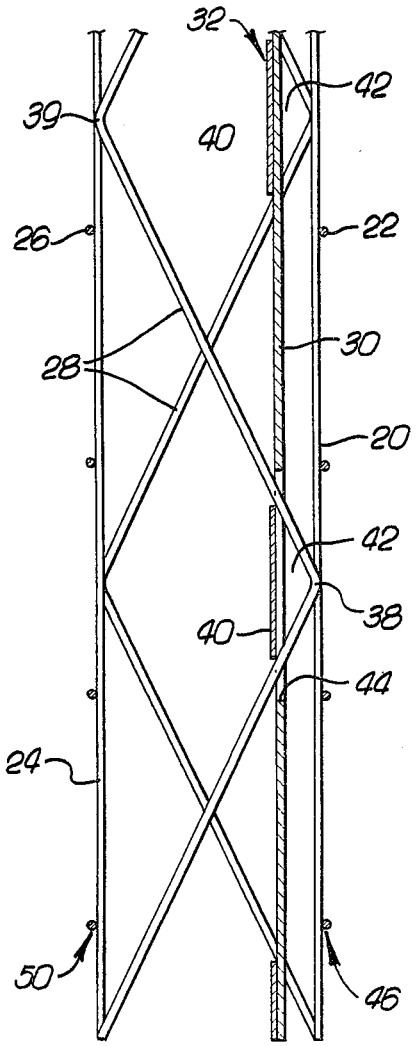
FIG. 6 is a partial vertical section taken along line 6—6 in FIG. 1 and showing the mesh, the backing, the strips and the wires.
Figure 8:
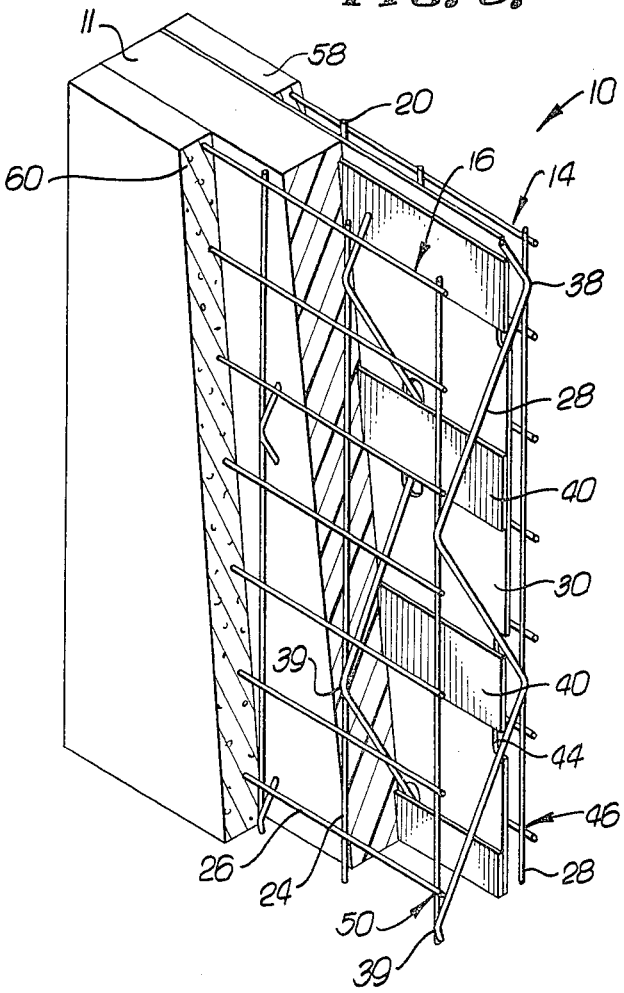
FIG. 8 is a fragmentary perspective view of the panel shown in FIG. 6 covered with the outer wall covering.

As shown in FIGS. 2 and 8, the modular panel 10 is a rectangularly shaped lattice 13 having two parallel major lateral surfaces, an upper surface 14 and a lower surface 16 as well as, side surfaces 17 and end surfaces 18. As the panel is fabricated with its major lateral surfaces lying in a horizontal plane, it will be described in reference to that position, e.g. the upper surface 14 describes a horizontal surface. When the panel is erected at the job site, the major lateral surfaces reside in a vertical plane and the surfaces will be described with reference to the wall the panels 10 form. The lattice 13 has a plurality of upper longitudinal spaced apart members 20 and a plurality of upper transverse spaced apart members 22 defining the upper surface 14, and a plurality of lower longitudinal spaced apart members 24 and a plurality of parallel lower transverse members 26, defining the lower surface 16. The side 17 and end 18 surfaces are defined between outermost longitudinal members 20 and 24 and outermost transverse members 22 and 26 respectively. The longitudinal members 20 and 24, and the transverse members 22 and 26 cooperate to provide much of the strength and stiffness of the panel 10.

A plurality of zig-zag wires 28 hold the insulating mass 11 within the panel 10. The wires 28 are configured as to trace a zig-zag path composed of straight portions connected by complementary angles. One wire 28 lies adjacent to each of the planes defined by a corresponding set of upper 20 and lower 24 longitudinal members.

In accordance with the present invention, the insulation mass 11 is inserted into the panel 10 by spraying liquid insulation 12 into the panel and onto a backing 30 located within the lattice that contains the liquid insulation 12 and holds it as it hardens. The backing 30 is held within the lattice 13 parallel to the lateral surfaces by a web 32 which is attached to the zig-zag wires 28. Adhesive on the web 32 holds the backing 30 to the web and prevents it from moving when the liquid insulation 12 is blown into the panel 10. The invention also includes a method of fabricating panel 10 containing the backing 30 and the web 32 by positioning the zig-zag wires 28 between elongated rectangular forms 36, connecting the web 32 to the wires, and then attaching the backing to the web before the longitudinal members 20 and 24 and transverse members 22 and 26 are attached to the wires 28.

In order to best describe the invention panel 10 and its materials, and the method of fabricating it will first be described. Thereafter, the method by which the panel 10 can be used in constructing buildings will be described. The panel is comprised of zig-zag wires 28 running between planes defined by longitudinal 20 and 24 and transverse 22 and 26 members. In the preferred embodiment the wires 28 and members 20, 22, 24 and 28 are cylindrical metallic materials. However, any material of suitable strength and ease of fabrication would be acceptable. The panel 10 is constructed by first fixing the wires 28 into a predetermined position, attaching the web and backing the wires, and then connecting upper members 20 and 22 and lower members 24 and 26 to the wires.

As shown in FIG. 2, the panel 10 is formed by placing a plurality of zig-zag wires 28 in the gaps between adjacent elongated rectangular forms 36 which are used to hold the wires in planes parallel to one another. The forms 36 are dimensioned so that angled portions of wires 28 extend above the uppermost surfaces of the forms. After the zig-zag wires 28 are positioned, the forms 36 are pushed against the wires 28 by a clamping means and the wires are held firmly in place.

As shown in FIG. 2, while the zig-zag wires 28 lie between the forms 36 in planes parallel to one another, the wires are positioned to be offset from one another in a direction paralleling the longitudinal members 20 and 24. The offset of the zig-zag wires 28 provides for a staggering of the locations of upper angles, hereafter called the upper points 38 and the lower angles or lower points 39 of the wires. It will be apparent that the points 38 and 39 may be sharp angles or merely curved portions of the wires 28.

In the present invention the zig-zag wires 28 are placed between the forms 36 in one of two positions. Alternating wires 28 occupy alternate positions so that the upper points 38 define a checkerboard pattern. In the preferred embodiment of the invention, the zig-zag wires 28 are spaced laterally apart about three inches and the upper points 38 of each wire 28 occur at twelve inch intervals.

After the wires 28 are clamped into place, such that about ⅜ of an inch of the upper points 38 extends above the top surfaces of the forms 36, the web 32 is connected to the wires. The web 32 is comprised of a plurality of parallel strips 40 which run laterally across the panel 10 passing through the triangular spaces 42 that are defined on two sides by those portions of the zig-zag wires 28 forming the upper points 38 and the third side by the top of the form 36. One strip passes under each lateral row. The strips 40, herein paper sheets having adhesive on their upper surface, lay atop and are supported by the top surface of the forms 36. The web 32 is formed when a strip runs through the triangular spaces 42 of each lateral row of upper points 38.

After the web 32 is formed, the backing 30 is attached to it. As can be seen in FIG. 2, the backing 30 is laid over the web 32 from the direction above the forms 36. A plurality of holes 44 are cut into the backing 30 at the locations where the upper points 38 intersect and would contact the backing as the backing is laid over the web 32. The holes 44 allow the upper points 38 to extend through the backing 30, and permit the backing to be placed immediately adjacent the web 32. When the web 32 and backing 30 are pressed together, the adhesive on the web holds the backing in place and prevents the backing from moving in a direction toward the top of the upper points 38. In the preferred embodiment, the backing is held approximately ⅜ of an inch from the tops of the upper points 38.

Once the web 32 and backing 30 are positioned, the upper longitudinal 20 and upper transverse 22 members can be attached to the zig-zag wires 28 of the panel 10. In the preferred embodiment the longitudinal 20 and transverse 22 members are connected to each other to form a top mesh 46 having three inch spacing between adjacent members. In order to hold the mesh 46, or the individual longitudinal 20 and transverse 22 members, in position to be attached to the zig-zag wires an outer framework 48 is placed outside the forms 36 and the top mesh 46 is placed atop the framework 48.

The framework 48 is a rectangular shaped border enclosing the forms 36 and is dimensioned to be able to support the top mesh 46 in the plane of the tops of the upper peaks 38.

Figure 4:
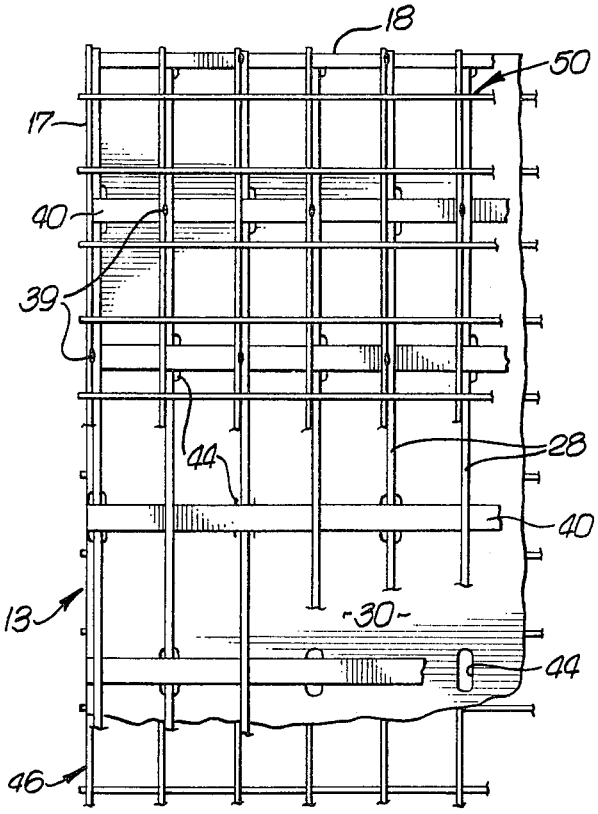
FIG. 4 is an elevational view of a panel viewed from outside the wall showing an outside mesh, the backing and a plurality of upper points extending through the backing.
Figure 3:
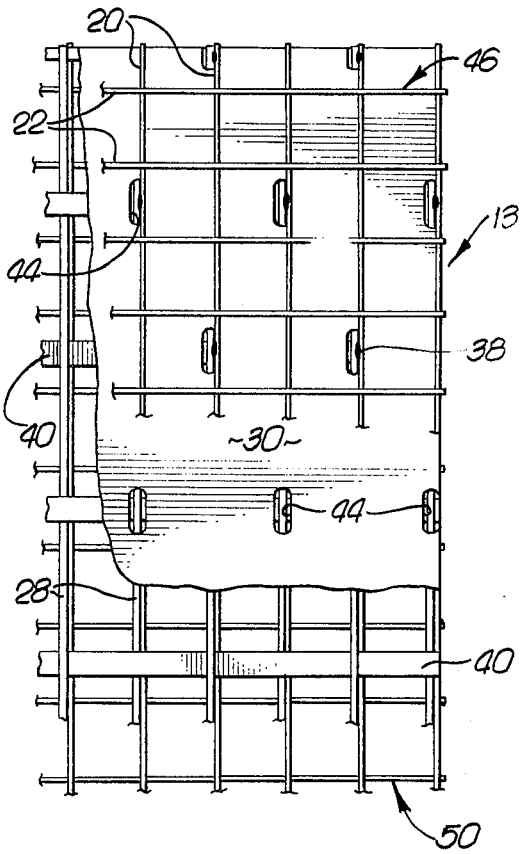
FIG. 3 is an elevational view of the panel viewed from inside the wall showing an inside mesh, the wires, the strips and part of the backing.

The top mesh 46 is positioned as is shown in FIGS. 3 and 4 so that the upper points 38 are adjacent to the upper longitudinal members 20 between their intersections with the upper transverse members 22. The upper points 38 are attached to the longitudinal members by spot welding although any other convenient manner of attachment can be used.

After the top mesh 46 is attached to the zig-zag wires 28, the panel 10 is removed from the forms 36 and a bottom mesh 50 is attached to the lower points 39 in a manner similar to that used to attach the top mesh 38 to the upper points 38. With the bottom 50 and top 46 meshes have been attached, the panel 10, measuring four feet by eight feet, is complete and ready for use.

Figure 9:
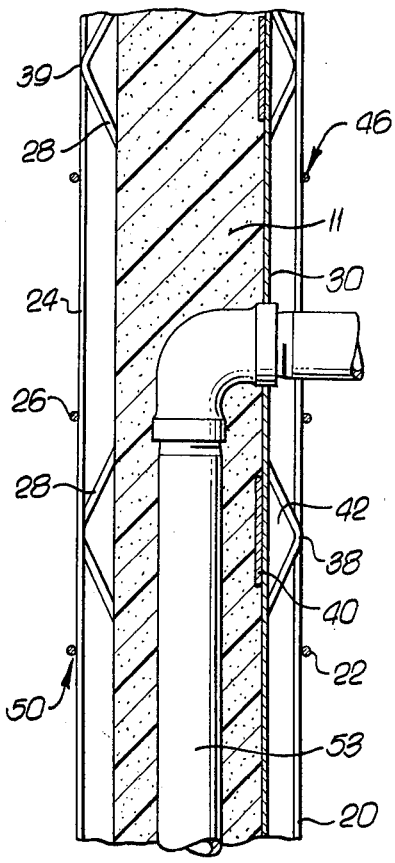
FIG. 9 is a partial vertical section of the panel showing a water pipe located inside the panel.
Figure 10:
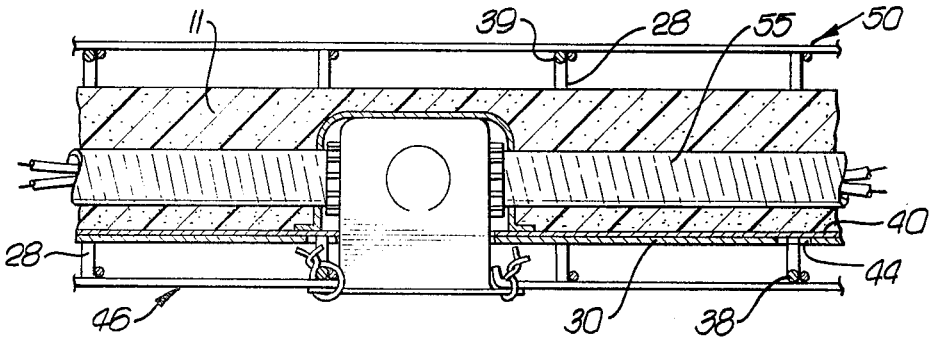
FIG. 10 is a partial vertical section of the panel showing an electrical box inside the panel.

When panels 10 of the invention are used in construction, they are stood erect in the position of the wall they will occupy on their end surfaces 18 so that their sides 17 are vertical. Adjacent panels 10 are joined to one another along their sides 17 with wire fasteners or other suitable connecting means. Should the wall section to be formed require a dimension not divisible by four feet, the normal width or end 18 dimension of the panel 10, a portion of a panel may be cut away with cutting snips in order to form a panel which will complete the wall. Water piping 53 and electrical conduit 55 can be enclosed within the panels 10 as is shown in FIGS. 9 and 10. The panels are connected so that the upper surfaces 14 face the inside portion of the wall. The wall can be supported during the connecting process by any conventional bracing.

After the wall is fastened together, laborers, as shown in FIG. 1, using spray guns 56 spray the liquid insulation 12 into the panel 10 from the outside of the wall. The insulation 11 used herein is polyurethane having a foaming agent which causes the liquid to begin foaming after it leaves the spray gun 56. The insulation is applied in layers of about one inch thick, allowing a sufficient hardening time between layers, until the desired thickness of the insulating mass 12 is obtained. It may be necessary for one laborer to remove the insulation 11 which may collect on the bottom mesh 50. Removal of collected insulation 11 can be done by brushing the insulation 11 off the bottom mesh 50.

Figure 7:
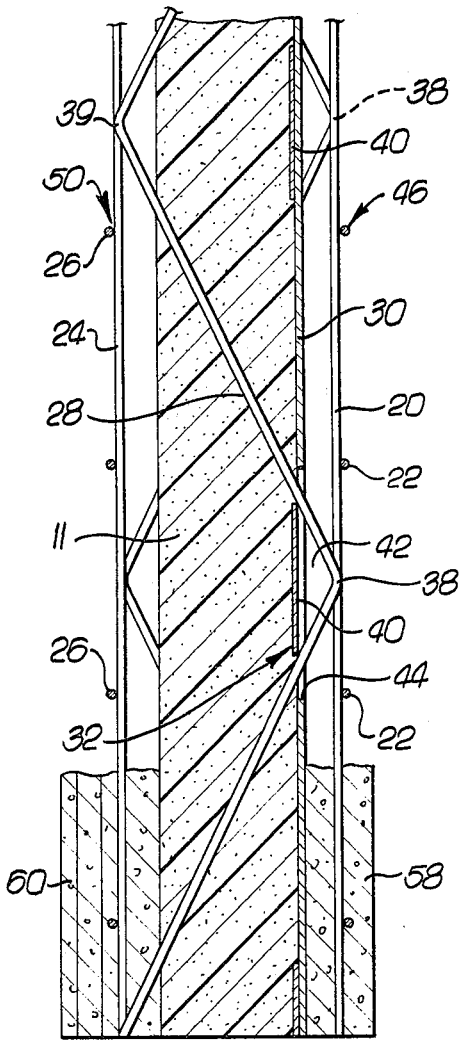
FIG. 7 is a view of the panel shown in FIG. 6 covered with insulation and an outer wall covering.

Surface coatings can be applied to the panel 10 once the insulation mass 12 is formed. Plaster 58, or other interior surfacing is applied to the inside or upper panel surface 14 and stucco 60 or exterior surfacing is applied to the lower panel surface 16. The top mesh 46 acts as a lath for the plaster, which the bottom mesh 50 acts as a lath for the stucco. Stucco is applied in the conventional manner such as the three coat covering shown in FIG. 7.

From the foregoing it will be appreciated that the present invention provides a novel method for fabricating walls using only a lattice panel 10, liquid insulation 12 and wall coating such as plaster 58 and stucco 60. The present panel 10, within its liquid containing backing 30, permits insulation 11 to be rapidly and inexpensively placed within the panels 10 by spraying the liquid insulation onto the wall. Thus, an entire wall can be formed in place by fastening together a number of panels 10 into which the insulation 12 is then sprayed.

The unicellular nature of the insulating material that is formed by spraying liquid insulation 12 onto the wall greatly improves the insulating qualities of walls so formed. The insulation in the present invention eliminates the possibility of gaps which, if existing between the insulating portions of adjacent panels 10, would permit both air and water to pass across the insulating boundary. Thus, the present invention eliminates the possibility of air and water leaks and provides a wall which has a greatly increased insulating efficiency and is also waterproof.

Portions of the panel also act as a plaster supporting lath, thus enabling the builder to plaster over the insulation, completely covering the insulating structure, and forming a smooth continuous wall surface. The simplicity of the method of construction allows a builder to install insulation more quickly and to install it using laborers needing only a few skills, thereby reducing the cost of construction.

While various embodiments of the invention have been illustrated and described, it will be apparent that various modifications can be made without departing from the spirit and scope of the invention.

I claim:

1. A panel for receiving a supply of liquid insulating material and producing therefrom a modular insulating building panel of the type over which surface coatings such as plaster and stucco can be applied, comprising:

a plurality of slender, elongated rods arranged to define a 3-dimensional lattice, said lattice having a pair of substantially parallel major lateral upper and lower surfaces, side surfaces, and end surfaces;

a plurality of wires transversing the interior of said lattice and interconnecting said major lateral surfaces to define a plurality of passages within said lattice, said wires describing identical zig-zag paths, having upper and lower points that alternatingly approach the upper and lower major lateral surfaces and being disposed within said lattice to form in said upper lateral surface rows of upper points extending perpendicularly to the path of said wires;

fabric means for containing the supply of liquid insulating material defining a plane parallel to said major lateral surfaces, said fabric means being impervious to said supply; and a web for positioning said containing means, said web being fixedly attached to said wires in a plane parallelling said major lateral surfaces having portions lying within the interior of said upper points.

2. A panel as described in claim 1 wherein:

said web comprises a plurality of strips extending across said lattice along one of said rows of upper points, each strip passing within said interior of said upper points in said row, said interior containing said strips and retaining said strips from moving outside of said lattice; and an adhesive lies on the upper surface of said strips that acts to hold said fabric attached to said strips.

3. A panel as described in claim 2 wherein:

said fabric has apertures for receiving said upper peaks permitting said upper points to extend through the plane of said fabric whereby said fabric may lie in contact with said strips.

4. A panel as described in claim 3 wherein:

said fabric is a heavy gauge paper-like material having apertures sized to allow said fabric to rest about three eighths of an inch inside the outermost part of said upper points;

said strips are paper-like material disposed in said rows passing within said interior of each upper point in said row;

said wires have upper points at one foot intervals and are spaced apart within said lattice at three inch intervals.

5. A method for producing a wall from modular insulating building panels of the type over which surfacing materials can be applied, said method comprising:

positioning at the desired wall location a plurality of panels, each having a plurality of slender, elongated rods arranged to define a 3-dimensional lattice, said lattice having a pair of substantially parallel major lateral surfaces, side surfaces, and end surfaces, a plurality of wires transversing the interior of said lattice and interconnecting said major lateral surfaces to define a plurality of passages within said lattice, said wires extending across said lattice, tracing within said lattice a zig-zag path connecting straight sections and upper and lower points of said wires, said wires located within said lattice such that said points define rows extending across said lattice perpendicularly to the plane of said wires, fabric, impervious to a spray of insulation defining a plane parallel to said major lateral surfaces, and an interconnecting web fixedly attached to said wires holding said fabric in place, said web comprising a plurality of adhesive covered strips extending across said lattice parallel to said rows and each strip passing the interior of said points in said row, each panel being positioned so that said fabric lies closest the major lateral surface facing one side of the wall;

connecting the panels together to form an erect wall;

spraying coats of liquid insulation from a point remote from the wall onto said fabric where said insulation foams and hardens; and covering said insulation filled panel with wall surfacing materials by applying said surfacing materials over said insulation where said covering engages said rods forming said major lateral surfaces.

6. A method for constructing a framework used to receive a supply of liquid insulating material and produce therefrom a modular building panel of the type over which plaster can be applied, said framework having a plurality of slender elongated rods arranged to define a 3-dimensional lattice having a pair of substantially parallel major lateral surfaces, side surfaces, and end surfaces, a plurality of wires transversing the interior of said lattice and inter-connecting said major lateral surfaces to define a plurality of passages within said lattice, said wires describing zig-zag paths and having upper and lower points, fabric defining a plane parallel to said major lateral surfaces, and means attached to said wires and positioning said fabric with respect to said lattice, said method comprising:

positioning a plurality of uniformly shaped rectangular forms within said plurality of passages, the upper surfaces of said solids defining a plane parallel to said major lateral surface;

interlacing web members through said wires;

attaching said web members to said wires adjacent to said plurality of solids, such that said web members define a plane;

placing said fabric atop said plane-defining web where said web adhesively attaches to said fabric;

attaching a top mesh comprising longitudinal and transverse members to said upper points defining said upper lateral surface atop said fabric;

removing said framework from said forms; and attaching a bottom mesh to said lower points.

7. A method for producing a wall from modular insulating building panels of the type over which surfacing materials can be applied, said method comprising:

positioning at the desired wall location a plurality of panels, each having a plurality of slender, elongated rods arranged to define a 3-dimensional lattice, said lattice having a pair of substantially parallel major lateral surfaces, side surfaces, and end surfaces, a plurality of wires transversing the interior of said lattice and interconnecting said major lateral surfaces to define a plurality of passages within said lattice, said wires extending across said lattice, tracing within said lattice a zig-zag path connecting straight sections and upper and lower points of said wires, said wires located within said lattice such that said points define rows extending across said lattice perpendicularly to the plane of said wires, fabric, impervious to a spray of insulation defining a plane parallel to said major lateral surfaces, and a web in a plane parallelling said major lateral surfaces having portions lying within the interior of said upper points fixedly attached to said wires holding said fabric in place, each panel being positioned so that said fabric lies closest the major lateral surface facing one side of the wall;

connecting the panels together to form an erect wall;

spraying coats of liquid insulation from a point remote from the wall onto said fabric where said insulation foams and hardens; and covering said insulation filled panel with wall surfacing materials by applying said surfacing materials over said insulation where said covering engages said rods forming said major lateral surfaces.

* * * * *